US006012252A

United States Patent [19]

Kocznar et al.

[11] Patent Number: 6,012,252

[45] **Date of Patent: *Jan. 11, 2000**

[54] TURNING BLOCKING DEVICE

[75] Inventors: Wolfram Kocznar, Innsbruck; Peter Dermutz, Bergheim, both of Austria

[73] Assignee: Skidata Computer Gesellschaft m.B.H., Austria

[ * ] Notice: This patent is subject to a terminal disclaimer.

[21] Appl. No.: 08/875,149

[22] PCT Filed: Nov. 14, 1996

[86] PCT No.: PCT/AT96/00221

§ 371 Date: Jun. 25, 1997

§ 102(e) Date: Jun. 25, 1997

[87] PCT Pub. No.: WO97/18379

PCT Pub. Date: May 22, 1997

[30] Foreign Application Priority Data

Nov. 16, 1995 [AT] Austria ..... 1874/95

[51] Int. Cl.[7] ..... E06B 11/08

[52] U.S. Cl. ..... 49/46; 49/42

[58] Field of Search ..... 49/42, 43, 44, 49/45, 46, 47, 393; 235/93

[56] References Cited

U.S. PATENT DOCUMENTS

| | | | |
|---|---|---|---|
| 3,998,008 | 12/1976 | Collins | 49/47 |
| 5,203,111 | 4/1993 | Huber et al. | 49/42 |
| 5,235,783 | 8/1993 | Huber et al. | 49/42 |
| 5,349,781 | 9/1994 | Libardi | 49/47 |
| 5,542,211 | 8/1996 | Colombo | 49/42 |
| 5,704,163 | 1/1998 | Kocznar | 49/47 |
| 5,705,982 | 1/1998 | Faltings | 235/93 |

FOREIGN PATENT DOCUMENTS

| | | | |
|---|---|---|---|
| 506152 | 9/1992 | European Pat. Off. | 49/42 |
| 06 22518 | 4/1994 | European Pat. Off. . | |
| 1474706 | 7/1969 | Germany . | |
| 403267490 | 11/1991 | Japan | 49/42 |
| 2175348 | 11/1986 | United Kingdom . | |
| 9425720 | 11/1994 | WIPO . | |

*Primary Examiner*—Daniel P. Stodola
*Assistant Examiner*—Curtis A. Cohen
*Attorney, Agent, or Firm*—Lorusso & Loud

[57] ABSTRACT

A turnstile with a housing, a drive and a locking element with a barrier arm is set in motion following verification of the access authorization of a user wishing to pass, rotating the barrier arm from its blocking position into a position out of line of passage. The advance of the user is then detected by a downstream sensor, in particular an opto-electronic sensor, which causes the barrier arm to rotate further in the same direction into the blocking position.

22 Claims, 4 Drawing Sheets

TURNING BLOCKING DEVICE

BACKGROUND OF THE INVENTION

1. Field of the Invention

The invention concerns a turning blocking device for a passageway, with a blocking element rotatable by a drive and having a barrier arm blocking the passageway in a blocking position, and with a sensor element arranged behind the blocking position, whereby the blocking element, especially after checking the right of entry of a passing user, first opens the passage to the sensor element, and second, after detection of the passing user by the sensor element, turns further into the next blocking position.

2. Description of the Prior Art

Such a turnstile can be inferred from WO-A 94/25720, for example. There, after the right of entry has been checked, the drive motor is started and the barrier arm is moved over a small angle of about 10° into a stop position in which an electro-optical sensor is released. When the user has indicated his readiness to pass through by having moved into the detection range of the sensor, the driving motor is started again by means of the sensor and the blocking element is rotated until the next barrier arm is in the blocking position.

Conventional turnstiles have four or three barrier arms, turnstiles comprising three arms having a driving shaft inclined by about 45° for space-saving reasons. Hence, in the passing direction the space available to the user is small and short since the turnstile forms functionally a moving lock chamber having a front and a rear limitation. Passing through the turnstile may cause difficulties, particularly if the user carries articles, such as sports goods, bags etc. It currently occurs that the users themselves, in particular the articles they carry, get stuck between the barrier arms.

SUMMARY OF THE INVENTION

The task of the invention is to eliminate the above-mentioned disadvantages and to increase the convenience of passage, especially for users carrying articles.

In a first embodiment, this is achieved by providing the blocking element with a single barrier arm only that is rotated about an angle of about 360° between each blocking position. Alternatively, a second embodiment can solve the problem by providing the blocking element with two barrier arms offset at 180° that are rotated about an angle of 180° between each blocking position.

When passage has been allowed by the control device permitting entry (card reader, coin machine, checking person etc.), the driving motor starts and rotates the blocking element about an angle of at least 90°, which may be as much as 270° if a single barrier arm is provided, so that passage is completely unimpeded. Now, the user can pass, since no barrier arm, neither in front of him nor behind him, projects into the passageway, and gets after passing the blocking position into the range of the sensor. The latter-mentioned starts the driving motor again so that behind the user the barrier arm pivots again into the blocking position.

Hence, the number of barrier arms provided is such that there is at least one position in which passage is unimpeded over the full width without restriction and hindrance. Nevertheless, all requirements to the turning blocking device are fulfilled, i.e., there are provided a mechanical barrier against unauthorized passage in both directions, as well as all other possibilities for checking and counting users and for channelling users into one queue. In this arrangement, it is a particular advantage that in case of an emergency switching, it is only necessary to put the drive out of function only in the position of the barrier arm after the first partial rotation. For this purpose, parts need not be uncoupled or dismounted since passage is completely unimpeded after the first partial rotation.

DETAILED DESCRIPTION OF THE INVENTION

Figure 1:
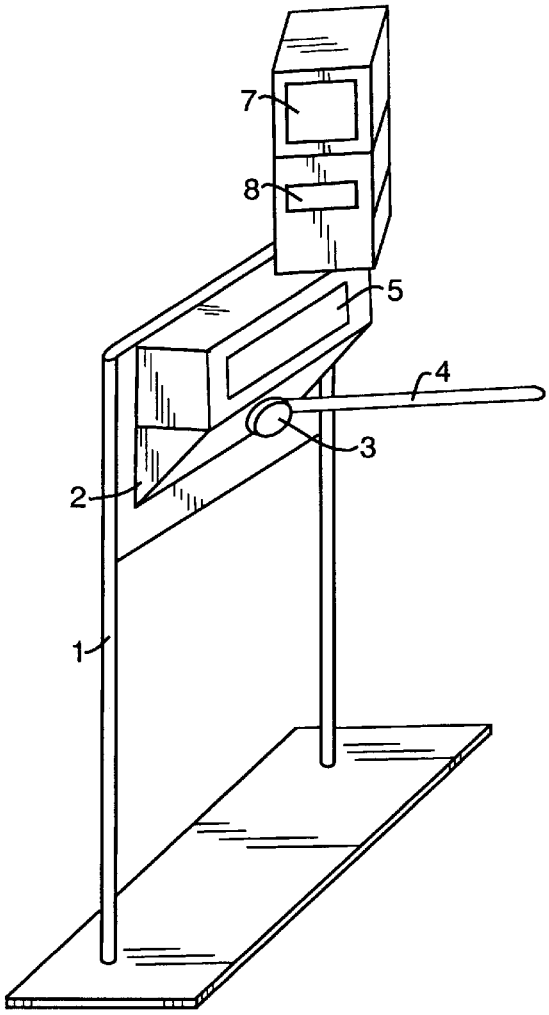
FIG. 1 is an angled view of a first embodiment of the turning blocking device in accordance with the present invention utilizing a single barrier arm.

In a preferred embodiment, the sensor is an optoelectric sensor but other types of presence or passage detectors are equally suitable.

The sensor is preferably installed above the drive shaft in the housing, so that the signal can be transmitted to control the motor in the usual way over permanent lines.

The optoelectric sensor can comprise at least one light scanner that responds to reflective changes in a beam of light emitted and that is equipped with a filter for outside light and background. The detection beam emitted is reflected by the passing user. The reflected light hits the first light receiver, which compares the portion of light received with that portion of light that is reflected on a second light receiver from the background further away. Since the positions of both light receivers are adjustable, the range of the detection beam can be limited by determining the distance between its point of intersection and the reflective beam of the second light receiver. This process of finding the difference is largely dependent on reflective properties. The light scanner preferably emits infrared light.

A direct current motor that can be short-circuited in the stop position may be used to drive the blocking device. Preferably, a worm wheel is also arranged on the drive shaft, into which a non-inhibiting worm fits, on whose shaft there is a magnetic brake and a device for determining the direction of rotation driven by the motor via a tractive mechanism. The magnetic brake can be activated in particular in the blocking position.

The invention will be explained in greater detail below using the figures in the enclosed drawings, but is not limited to them.

The housing 2 of a turning blocking device is arranged on a frame 1 so its height can be adjusted. The blocking device is assigned to a track, and has a blocking element 3 with a single barrier arm 4. The barrier arm 4 is in a blocking position, which is in an angle between 0° and roughly 10° in front of an imaginary center line. A worm wheel is attached to the shaft of the blocking element 3, into which a non-inhibiting worm fits, which is driven by an electric drive motor via a tractive mechanism. The blocking element 3 is held in the blocking position of the barrier arm 4 by an electromagnetic brake, which grips the shaft of the worm. A disk that recognizes the direction and angle of rotation is also arranged on this shaft with a detector assigned to it. The blocking device also has an optoelectric sensor 5, via which the drive motor is switched on and off, and, preferably, there is further provided a checking device 7 having a transmitting/receiving unit 8 for non-contact control, and, possibly, a magnetic card reader and a display.

Figure 2:
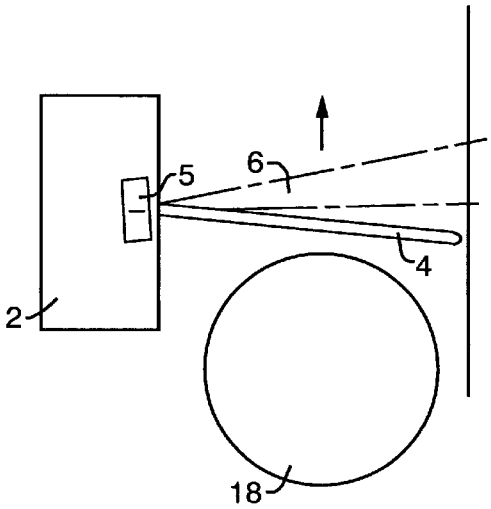
FIG. 2 is a schematic top view of the turning blocking device as shown in FIG. 1 showing a user being blocked by the device.
Figure 3:
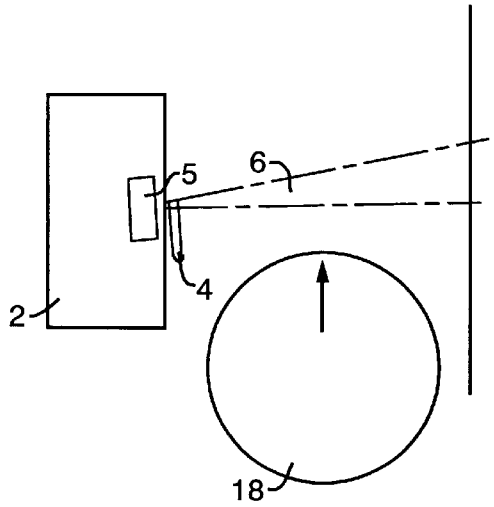
FIG. 3 is a schematic top view of the turning blocking device of FIG. 2 in an open position.
Figure 4:
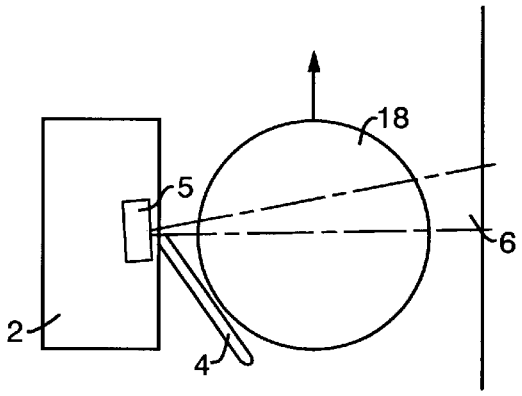
FIG. 4 is a schematic top view similar to FIG. 3 but showing the user in a trigger position.
Figure 5:
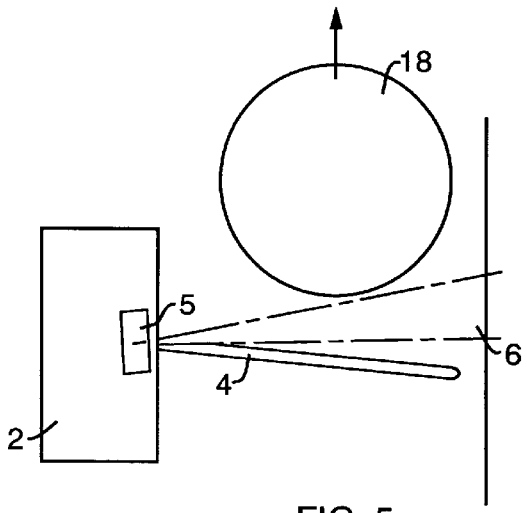
FIG. 5 is a schematic top view similar to FIG. 2 in an open position.
Figure 6:
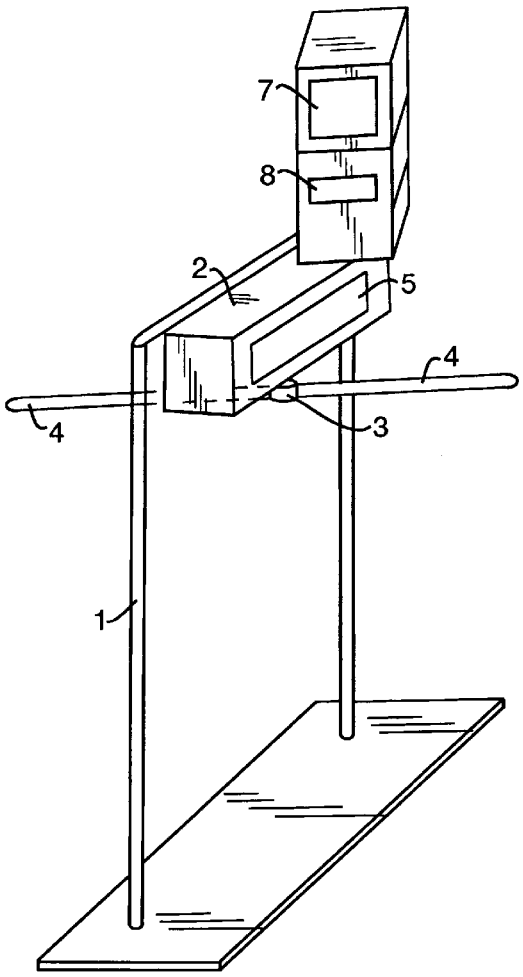
FIG. 6 is an angled view of a second embodiment of the turning blocking device in accordance with the present invention, utilizing two barrier arms.
Figure 7:
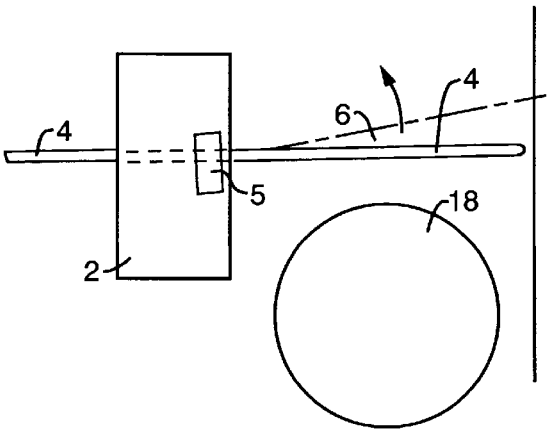
FIG. 7 is a schematic top view of the turning blocking device as shown in FIG. 6 showing a user being blocked by the device.

The blocking position of the blocking device is shown in FIGS. 2 to 5. A user 18 standing in front of the barrier arm 4 cannot be detected by the sensor, since its detection range is behind the barrier arm (FIG. 2). If the checking device 7 gives permission for passage through the track, the brake is released and the drive motor turns the barrier arm 4 out of the locked position into a stop position in which the motor is stopped again. The blocking element 3 turns about 180 to 210 degrees in order to allow access to the detection range 6 and to make passage totally unimpeded. If the user 18 moves forward he enters the detection range 6, as can be seen in FIG. 4, and via the sensor 5 the motor of the blocking device is turned on again. The motor turns the blocking element 3 in the same sense of rotation until the barrier arm 4 goes into the blocking position, in which the brake is reactivated. An exact position of the barrier arm 4 in the blocking position and in the stop position is of subordinate significance.

It is of advantage to provide for a relatively quick second partial rotation from the intermediate position into the locking position so that the following user is stopped from unauthorized passage. Hence, the second partial rotation should not exceed 90°.

Figure 8:
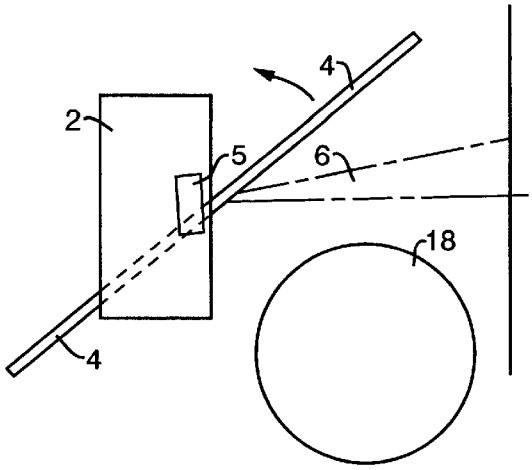
FIG. 8 is a schematic top view of the turning blocking device of FIG. 7 in an open position.
Figure 9:
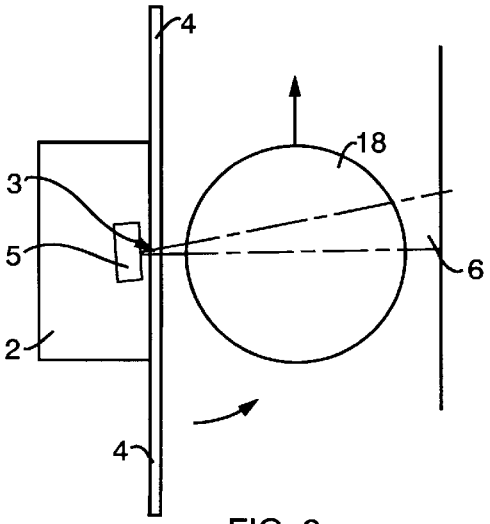
FIG. 9 is a schematic top view of the turning blocking device of FIG. 8 in an opened position.
Figure 10:
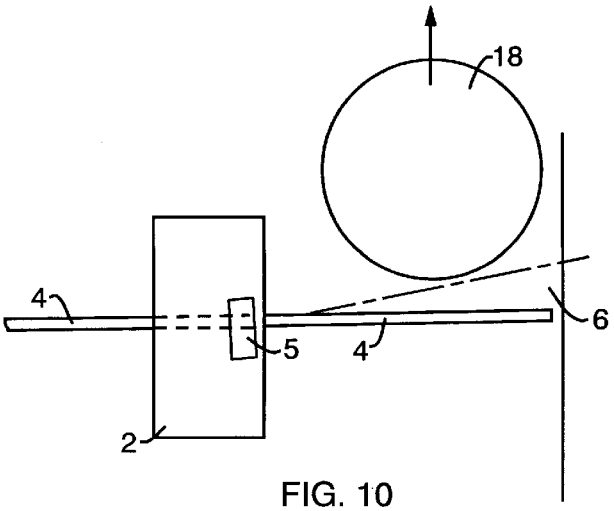
FIG. 10 is a schematic top view of the turning blocking device similar to FIG. 8 in an open position.

In the second embodiment according to FIGS. 6 to 10, the blocking element 3 has two barrier arms 4 offset at 180°. In this arrangement, too, a first partial rotation about 90° also gives free passage, as can be seen in FIGS. 8 and 9.

The turning blocking device according to the invention is independent of the height of the users or of articles moving with them. It is therefore also conceivable to use the turning blocking device in connection with lanes for motor vehicles, for example at the entry into car parks.

What is claimed is:

1. A turning blocking device including a passageway, the blocking device for blocking a user from passing through said passageway, comprising:

a housing enclosing a drive shaft connected to a drive motor, a rotatable blocking element connected to said drive shaft, said blocking element having one and only one barrier arm, which blocks said passageway and prevents the user from passing through said passageway when in a first blocking position when said housing is mounted beside said passageway, an optical sensor element mounted on said housing, said optical sensor element sensing changes in light, when the user passes through said passageway by sensing changes in a light detection range projected in a path of travel reached by the user after passing beyond said blocking position of said barrier arm, said barrier arm being turned in one direction from said blocking position into an intermediate position remote of said passageway in order to allow passage of the user, said barrier arm being turned further, after detection of the user passing through said light detection range projected in the path of travel, by said optical sensor activating said drive motor after passage of the user through said light detection range projected in the path of travel so that said blocking arm rotates in the same direction to a second blocking position.

2. The turning blocking device according to claim 1, wherein said single barrier arm rotates through an angle of rotation no greater than 360° between each blocking position.

3. The turning blocking device according to claim 2, wherein said barrier arm is rotated by a drive motor.

4. The turning blocking device according to claim 3, wherein said optical sensor is an opto-electronic sensor.

5. The turning blocking device according to claim 4, wherein said opto-electronic sensor comprises at least one light sensor for responding to reflective changes in a beam of light emitted.

6. The turning blocking device according to claim 5, wherein said opto-electronic sensor comprises a filter for eliminating background light.

7. The turning blocking device according to claim 1, wherein said blocking element comprises a worm wheel attached to a shaft of said blocking element, and a non-inhibiting worm engages said worm wheel, said non-inhibiting worm being driven by an electric drive motor.

8. The turning blocking device according to claim 7, wherein said electric drive motor functions via a tractive mechanism.

9. The turning, blocking device according to claim 1, also including a control device for activating the turning blocking device.

10. The turning blocking device according to claim 9, wherein said control device comprises a coin machine.

11. The turning blocking device according to claim 9, wherein said control device comprises a card reader.

12. A turning blocking device including a passageway, the blocking device for blocking a user from passing through said passageway, comprising:

a housing enclosing a vertically extending drive shaft connected to a drive motor;

a rotatable blocking element connected to said vertically extending drive shaft, said blocking element having two barrier arms positioned 180 degrees from each other from said vertically extending drive shaft, each of said barrier arms blocking passageway one at a time when in a blocking position when said housing is mounted beside said passageway;

an optical sensor element mounted on said housing, said optical sensor element sensing changes in light caused by the user passing through said passageway, said optical sensor sensing changes in a light detection range projected in a path of travel reached by the user after passing beyond said blocking position of said barrier arms, each of said barrier arms being turned in one direction from said blocking position into an intermediate position parallel to said passageway in order to allow passage the user, and being capable of being turned further, after detection of the passing user passing through said light detection range projected in the path of travel, said optical sensor activating the drive motor after passage of the user through said light detection range projected in the path of travel, so that said barrier arms rotate in the same direction to a second blocking position.

13. The turning blocking device according to claim 12, wherein said blocking element turns through an angle of 180° between each blocking position.

14. The turning blocking device according to claim 13, wherein each of said barrier arms is rotated by a drive motor.

15. The turning blocking device according to claim 14, wherein said optical sensor is an opto-electronic sensor.

16. The turning blocking device according to claim 15, wherein said opto-electronic sensor comprises at least one light sensor for responding to reflective changes in a beam of light emitted.

17. The turning blocking device according to claim 16, wherein said opto-electronic sensor comprises a filter for eliminating background light.

18. The turning blocking device according to claim 12, wherein said blocking element comprises a worm wheel attached to a shaft of said blocking element, and a non-inhibiting worm engages said worm wheel, said non-inhibiting worm being driven by an electric motor.

19. The turning blocking device according to claim 18, wherein said electric drive motor functions via a tractive mechanism.

20. The turning blocking device according to claim 12, also including a control device for activating the turning blocking device.

21. The turning blocking device according to claim 20, wherein said control device comprises a coin machine.

22. The turning blocking device according to claim 21, wherein said controlling device comprises a card reader.

* * * * *